US008169202B2

(12) United States Patent
Chen

(10) Patent No.: US 8,169,202 B2
(45) Date of Patent: May 1, 2012

(54) LOW DROPOUT REGULATORS

(75) Inventor: Tun-Shih Chen, Pingtung County (TW)

(73) Assignee: Mediatek Inc., Hsin-Chu (TW)

( * ) Notice: Subject to any disclaimer, the term of this patent is extended or adjusted under 35 U.S.C. 154(b) by 537 days.

(21) Appl. No.: 12/392,310

(22) Filed: Feb. 25, 2009

(65) Prior Publication Data

US 2010/0213908 A1 Aug. 26, 2010

(51) Int. Cl.
*G05F 1/44* (2006.01)

(52) U.S. Cl. ..... 323/273

(58) Field of Classification Search ..... 323/223, 323/267, 270–275, 281–285; 361/18, 100, 361/101
See application file for complete search history.

(56) References Cited

U.S. PATENT DOCUMENTS 4,218,647 A * 8/1980 Haas ..... 323/268
4,593,338 A * 6/1986 Takeda et al. ..... 361/18
5,578,916 A 11/1996 Muterspaugh
5,710,508 A * 1/1998 Watanabe ..... 323/284
5,754,419 A * 5/1998 Ho ..... 363/89
6,998,826 B2 * 2/2006 Fukui ..... 323/282
7,545,609 B2 * 6/2009 Suzuki ..... 361/18

FOREIGN PATENT DOCUMENTS

CN 101739053 6/2010

OTHER PUBLICATIONS

English language translation of abstract of CN 101739053 (published Jun. 16, 2010).

* cited by examiner

*Primary Examiner* — Adolf Berhane
(74) *Attorney, Agent, or Firm* — Thomas|Kayden

(57) ABSTRACT

Low dropout regulators capable of preventing damage caused by a short circuit or a heavy load are provided, in which a pass transistor receives an unregulated power supply voltage to generate a regulated output voltage according to a control signal. Additionally, a constant overcurrent limiting circuit limits an output current through the pass transistor to below a predetermined current, and a foldback overcurrent limiting circuit enables the constant overcurrent limiting circuit to further decrease the output current, when the regulated output voltage is lower than a predetermined voltage.

17 Claims, 5 Drawing Sheets

LOW DROPOUT REGULATORS

BACKGROUND OF THE INVENTION

1. Field of the Invention

The invention relates to power regulation, and more particularly, to low dropout (LDO) regulators capable of preventing damage caused by a short circuit or a heavy load.

2. Description of the Related Art

A regulator converts an unstable power supply voltage into a stable power supply voltage. A low dropout (LDO) regulator has a low input-to-output voltage difference between an input terminal where an unstable power supply voltage is inputted and an output terminal where a stable power supply voltage is outputted. "Dropout voltage" refers to the input-to-output voltage difference, whereby the regulator ceases to regulate against further reductions in input voltage. Ideally, the dropout voltage should be as low as possible, to allow the input voltage to be relatively low, while still maintaining regulation. Thus, assuring that the input-to-output voltage difference is low and minimizing power dissipation and maximizing efficiency are important.

Generally, the conventional LDO regulator includes a protection circuit such as an over-current protection circuit so as to protect the circuit during abnormal operating conditions. For example, the over-current protection circuit maintains the output current (IOUT) of the LDO at a predetermined current value and controls the LDO to reduce the output current (IOUT) when an output voltage (VOUT) thereof is lower than a predetermined value caused by a heavy load (i.e. a short circuit occurs).

However, the foldback voltage of the conventional LDO is not accurate, the foldback voltage is affected by ambient temperature and adjustment range of the foldback voltage is limited. Further, after the output voltage is foldback, the output current correlates with the ambient temperature, other circuit parameters and process parameters, and thus, control of the output current is difficult.

BRIEF SUMMARY OF THE INVENTION

Embodiments of a low dropout regulator are provided, in which a pass transistor receives an unregulated power supply voltage to generate a regulated output voltage according to a control signal, a constant overcurrent limiting circuit limits an output current through the pass transistor to below a predetermined current, and a foldback overcurrent limiting circuit enables the constant overcurrent limiting circuit to further decrease the output current, when the regulated output voltage is lower than a predetermined voltage.

The invention provides an embodiment of an overcurrent protection circuit, in which a constant overcurrent limiting circuit limits an output current through a pass transistor below a predetermined current, and a foldback overcurrent limiting circuit enables the constant overcurrent limiting circuit to further decrease the output current, when the regulated output voltage is lower than a predetermined voltage.

The invention provides an embodiment of a method for providing overcurrent protection in a regulator, in which an output current through a pass transistor in the power regulator is limited to below a predetermined current by a constant overcurrent limiting circuit, and the predetermined current is decreased to enable the constant overcurrent limiting circuit to further decrease the output current according to the decreased predetermined current, when a regulated output voltage of the pass transistor is lower than a predetermined voltage.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
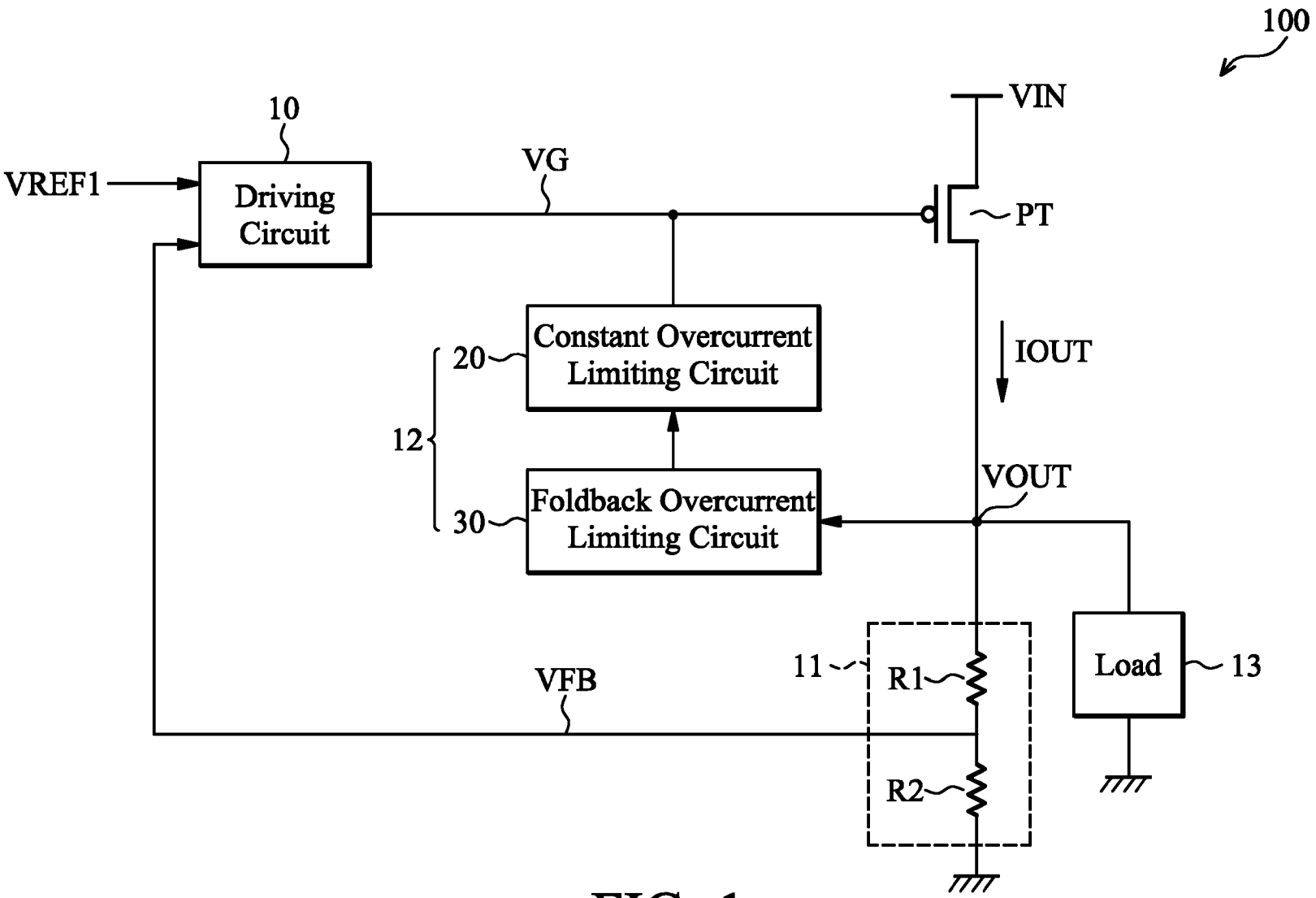
FIG. 1 is a schematic diagram of an embodiment of a low dropout (LDO) regulator.

FIG. 1 is a schematic diagram of an embodiment of a low dropout (LDO) regulator 100 mainly comprising a pass transistor PT, a driving circuit 10, a feedback circuit 11, and an overcurrent protection circuit 12. The feedback circuit 11 comprises resistors R1 and R2. An unregulated power supply voltage VIN is applied to a power line. The pass transistor PT receives the unregulated power supply voltage VIN and generates an output voltage that varies depending upon a control signal VG, and outputs to a load 13. The feedback circuit 11 detects a current flowing through the pass transistor PT and generates a feedback signal VFB. The output voltage VOUT is divided by the resistors R1 and R2, and the divided voltage of the output voltage VOUT becomes the feedback signal VFB.

The driving circuit 10 compares the feedback signal VFB with a reference voltage VREF1 from a reference voltage generator and generates the control signal VG that varies depending upon the voltage difference between the reference signal VREF1 and the feedback signal VFB. For example, the driving circuit 10 comprises an error amplifier, but is not limited thereto. In preferred embodiments, the reference voltage generator provides the reference voltage VREF1 regardless of manufacturing process variations and/or temperature variations.

The overcurrent protection circuit 12 prevents the LDO regulator 100 from damage caused by overcurrent. The overcurrent protection circuit 12 comprises a constant overcurrent limiting circuit (COLC) 20 and a foldback overcurrent limiting circuit (FOLC) 30. The COLC 20 detects an output current IOUT flowing through the pass transistor PT and limits the output current IOUT to below a predetermined current. For example, the COLC 20 detects the output current IOUT and pulls a voltage level of the gate terminal of the pass transistor PT high (i.e., increases the voltage level of the control signal VG) when the output current IOUT exceeds the predetermined current, thereby suppressing the increased output current IOUT.

Because the output current IOUT is limited by the COLC 20, the output voltage VOUT decreases when a short circuit (i.e., a heavy load condition) occurs, such that the voltage across the pass transistor PT overly increases. In this example, the excessive voltage may burn out the pass transistor PT or some component in the LDO regulator 100, such that the LDO regulator 100 fails to operate. However, the FOLC 30 enables the COLC 20 to further decrease the output current IOUT when the output voltage VOUT is lower than a predetermined voltage because of a short circuit (or a heavy load condition), thereby preventing damage caused by excessive voltage across the pass transistor PT. For example, the FOLC 30 decreases the predetermined current for limiting the output current IOUT when the output voltage VOUT is lower than the predetermined voltage, such that the COLC 20 further decreases the output current IOUT according to the decreased predetermined current. In some examples, the FOLC 30 can compare the output voltage VOUT with a reference voltage to determine whether the output voltage VOUT is higher than the predetermined voltage. Alternatively, the FOLC 30 can compare a division voltage of the output voltage VOUT with a reference voltage to determine whether the output voltage VOUT is higher than the predetermined voltage. The detailed operations of the overcurrent protection circuit 12 will be illustrated hereinafter.

Figure 2:
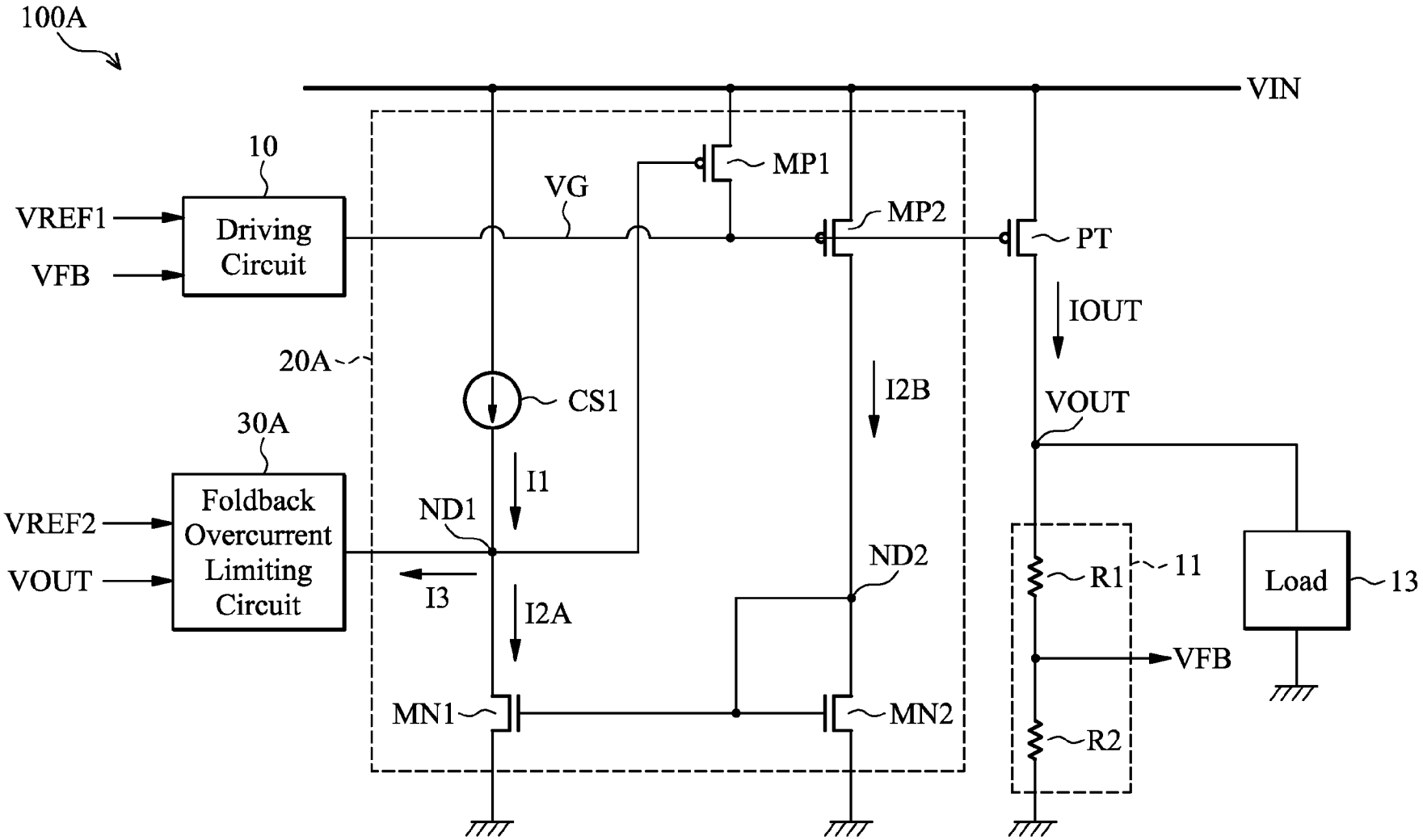
FIG. 2 shows an embodiment of the LDO regulator.

FIG. 2 shows an embodiment of the LDO regulator. As shown, the LDO regulator 100A is similar to the LDO regulator 100 in FIG. 1, differing only, in that the COLC 20A is implemented by a constant current source CS1, PMOS transistors MP1 and MP2 and NMOS transistors MN1 and MN2, and the FOLC 30A compares the output voltage VOUT with a reference voltage VREF2 to determine whether a short circuit (a heavy load) has occurred. Operations of the components which are similar to that in the LDO regulator 100 are omitted for simplification.

The constant current source CS1 is coupled between the unregulated power supply voltage VIN and a node ND1 to provide a constant current I1. The NMOS transistor MN1 comprises a drain terminal coupled to the node ND1, a source terminal coupled to a ground voltage, and a gate terminal coupled to the NMOS transistor MN2. The NMOS transistor MN2 comprises a drain terminal coupled to a gate terminal thereof, and a source terminal coupled to the ground voltage, in which the size of the NMOS transistor MN1 is in proportion to that of the NMOS transistor MN2. The NMOS transistors MN1 and MN2 form a current mirror, and a current I2A flowing through the NMOS transistor MN1 is in proportion to a current I2B flowing through the NMOS transistor MN2. The current I2A can be regarded as a mirror current of the current I2B. The PMOS transistor MP1 comprises a source terminal coupled to the unregulated power supply voltage VIN, a drain terminal coupled to a gate terminal of the PMOS transistor MP2, and a gate terminal coupled to the node ND1. The PMOS transistor MP2 comprises a source terminal coupled to the unregulated power supply voltage VIN, a drain terminal coupled to the drain terminal of the NMOS transistor MN2, and a gate terminal coupled to the gate terminal of the pass transistor PT.

When the output voltage VOUT is higher than the reference voltage VREF2, the FOLC 30A does not work. For example, the current I3 can be zero, but is not limited thereto. Since the source terminals of the transistor MP2 and pass transistor PT are both coupled to the unregulated power supply voltage VIN and the gate terminals are both coupled to the control signal VG from the driving circuit 10, the current I2B through the PMOS transistor MP2 is in proportion to the output current IOUT, and thus, the PMOS transistor MP2 can be used to detect the output current IOUT flowing through the pass transistor PT. Because the current I2A is also in proportion to the current I2B, the current I2A is in proportion to the current IOUT. In this embodiment, the currents I2A and I2B increase as the output current increases, but is not limited thereto. In this case, the node ND1 can be regarded as a current comparator comparing the current I1 and the current I2A. When the current I2A is smaller than the current I1, the voltage level on the node ND1 rises to high (close to the unregulated power supply voltage VIN). On the contrary, when the current I2B exceeds the current I1, the voltage on the node ND1 falls (close to ground), such that the transistor MP1 is turned on to pull high the gate terminal of the pass transistor PT, thereby overcurrent. In a steady condition, the current I2A is approximately equal to the current I1, and the output current IOUT can be limited below a predetermined current. Namely, the predetermined current is in direct proportion to the current I1 provided by the constant current source CS1, and thus the predetermined current can be adjusted by increasing/decreasing the current I1.

In this embodiment, the FOLC 30A drains out a current I3 from the current I1 to enable the COLC 20A to further decrease the predetermined current, when the output voltage VOUT is lower than a predetermined voltage because of a short circuit (or a heavy load condition), the FOLC 30A enables the COLC 20A to further decrease the output current IOUT. For example, the current I3 drained by the FOLC 30A can be increased as the output voltage VOUT decreases, but is not limited thereto. At this time, the voltage on the node ND1 falls when the current I1 is smaller than the current (I2A+I3), and the voltage on the node ND1 rises when the current I1 exceeds the current (I2A+I3). Hence, the COLC 20A further decrease the output current IOUT until the sum of the current I2A (which is proportion to the output current IOUT) and the current I3 is approximately equal to the current I1 provided by the constant current source CS1. Namely, it can be regarded as that the COLC 20A limits the output current IOUT to below the decreased predetermined current. As a result, the output current IOUT decreases as the output voltage VOUT decreases, when a short circuit (or a heavy load condition) occurs. Thus, damage caused by a short circuit or a heavy load condition can be prevented.

Figure 3:
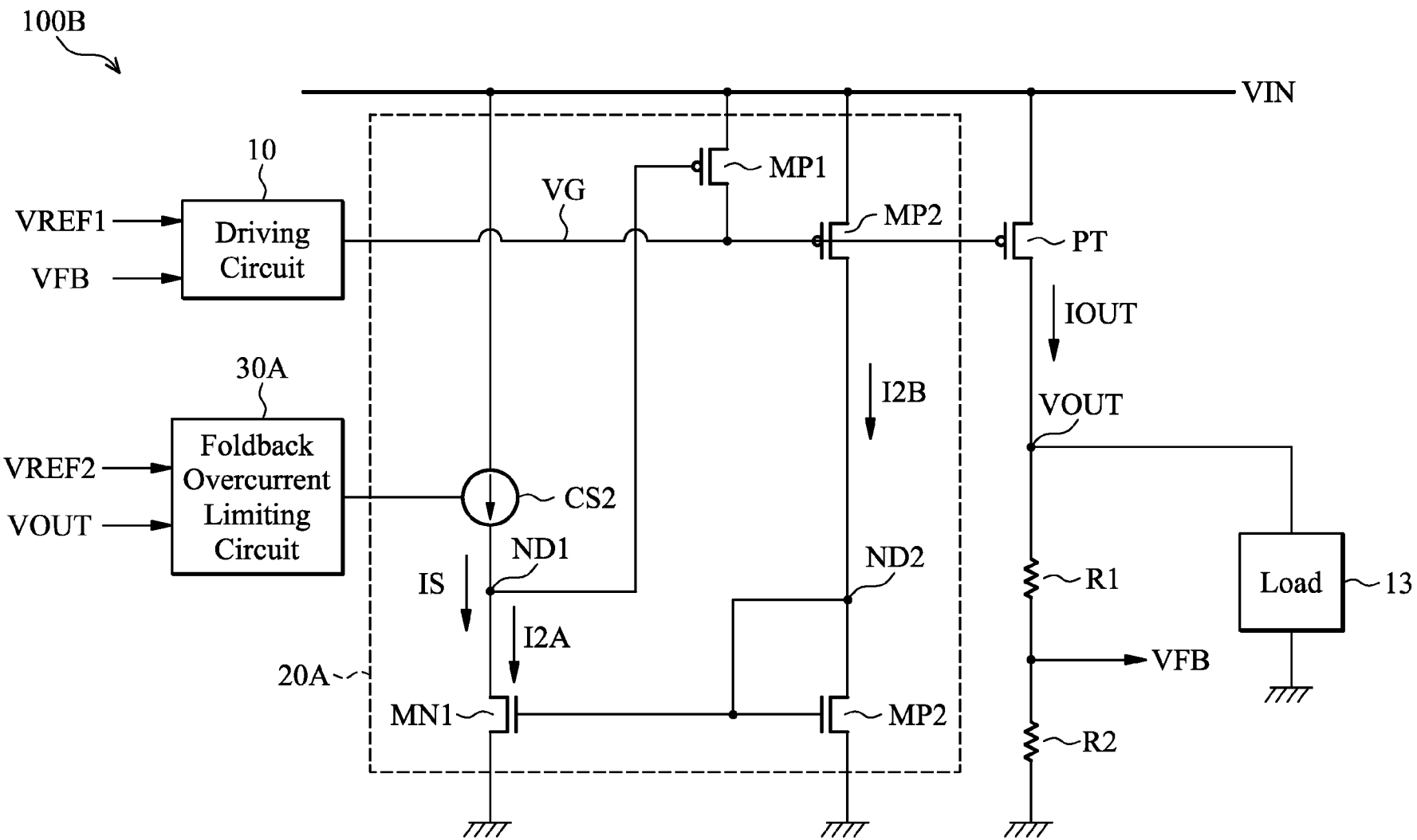
FIG. 3 shows another embodiment of the LDO regulator.

FIG. 3 shows another embodiment of the LDO regulator. As shown, the LDO regulator 100B is similar to the LDO regulator 100A in FIG. 2, differing only, in that constant current source CS1 is replaced by a controllable current source CS2, the FOLC 30A enables the current source CS2 to decrease the predetermined current when the output voltage VOUT is lower than the predetermined voltage, such that the output current IOUT is further decreased as the output voltage VOUT decreases.

As mentioned in FIG. 2, the predetermined current is in direct proportion to the current I1 provided by the constant current source CS1, and thus, in this embodiment, the current source CS2 decreases the current IS to decrease the predetermined current. At this time, the voltage level on the node ND1 falls when the current I2A decreased exceeds the decreased current IS, and the voltage level on the node ND1 rises when the current I2A is smaller than the decreased current IS. Namely, the COLC 20A further decrease the output current IOUT until the current I2A (which is proportion to the output current IOUT) is approximately equal to the current IS deceased by the current source CS2. It can be regarded as that the COLC 20A limits the output current IOUT to below the decreased predetermined current. As a result, the output current IOUT decreases as the output voltage VOUT decreases, when a short circuit (or a heavy load condition) occurs. Thus, damage caused by a short circuit or a heavy load condition can be prevented.

Figure 4:
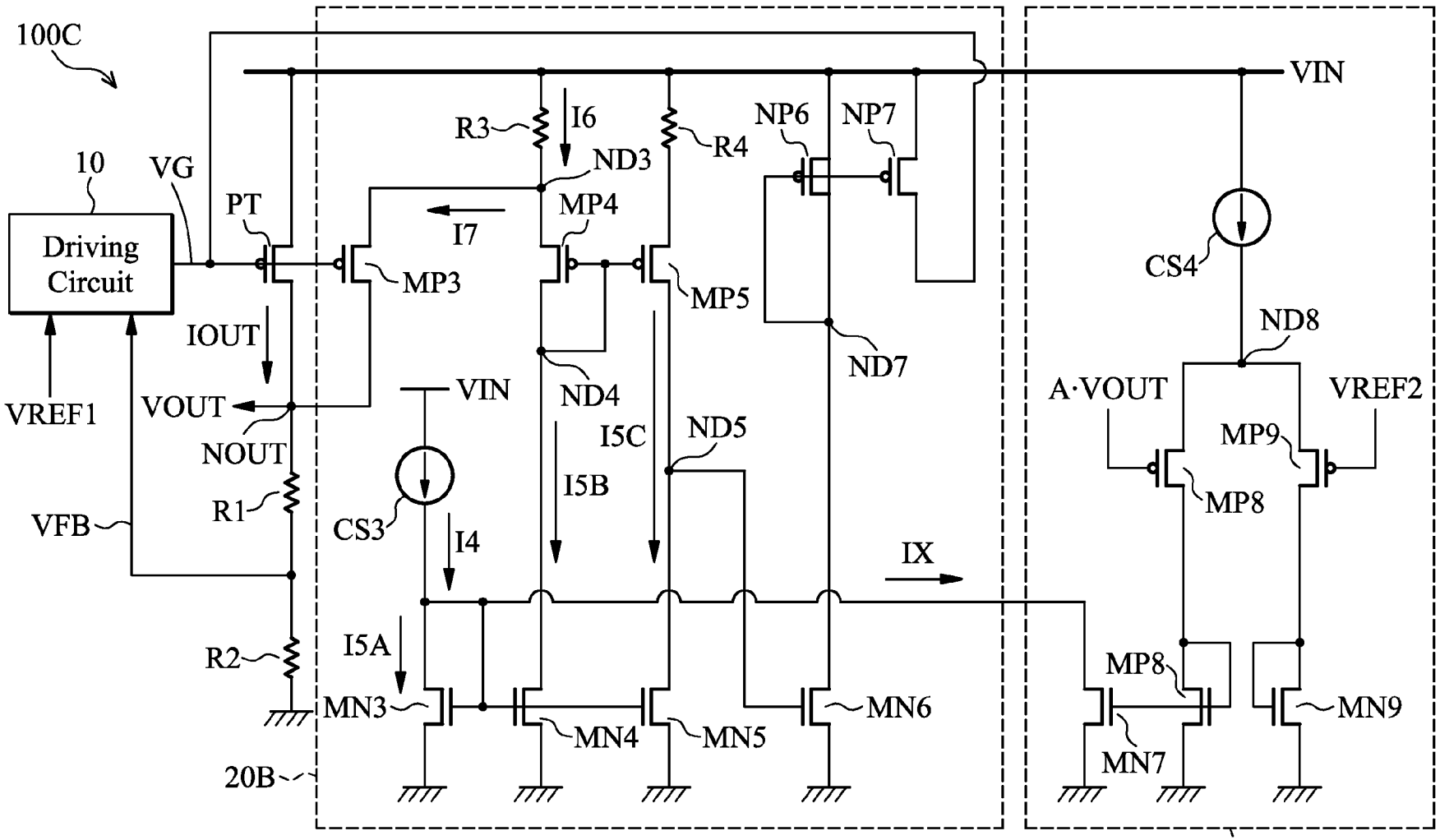
FIG. 4 shows another embodiment of the LDO regulator.

FIG. 4 shows another embodiment of the LDO regulator. As shown, the LDO regulator 100C is similar to the LDO regulator 100A in FIG. 2, differing only, in that the COLC 20B is implemented by a constant current source CS3, NMOS transistors NM3~MN6, PMOS transistors MP3~MP7 and resistors R3~R4, and the FOLC 30B is implemented by a constant current source CS4, PMOS transistors MP9~MP9 and NMOS transistors MN7~MN9. Operations of the driving circuit 10, the pass transistor PT and the resistors R1 and R2 are similar to that illustrated in FIG. 1 and thus, are omitted for simplification.

The PMOS transistor MP3 comprises a source terminal coupled to a node ND3, a drain terminal coupled to a node NOUT, and a gate terminal coupled to the gate terminal of the pass transistor PT. The resistor R3 is coupled between the unregulated power supply voltage VIN and the node ND3, and the PMOS transistor MP4 comprises a source terminal coupled to the node ND3, a drain terminal coupled to a node ND4 and a gate terminal coupled to the node ND4 and a gate terminal of the PMOS transistor MP5. The resistor R4 is coupled between the unregulated power supply voltage VIN and a source terminal of the PMOS transistor MP5, and the PMOS transistor MP5 comprises a source terminal coupled to the resistor R4, a drain terminal coupled to a node ND5 and a gate terminal coupled to the PMOS transistor MP3. The constant current source CS3 is coupled between the unregulated power supply voltage VIN and a node ND6, and the NMOS transistor MN3 comprises a drain terminal coupled to the node ND6, a source terminal coupled to the ground voltage, and a gate terminal coupled to the node ND6 and the NMOS transistor MN6.

The NMOS transistor MN4 comprises a drain terminal coupled to the node ND4, a gate coupled to the NMOS transistor MN3, and a source terminal coupled to the ground voltage. The NMOS transistor MN5 comprises a drain terminal coupled to the node ND5, a gate coupled to the NMOS transistors MN3 and MN4, and a source terminal coupled to the ground voltage GND. The NMOS transistor MN6 comprises a drain terminal coupled to a node ND7, a source terminal coupled to the ground voltage, and a gate terminal coupled to the node ND5. The PMOS transistor MP6 comprises a source terminal coupled to the unregulated power supply voltage VIN, a drain terminal coupled to the node ND7, and a gate terminal coupled to the node ND7 and the PMOS transistor MP7. The PMOS transistor MP7 comprises a source terminal coupled to the unregulated power supply voltage VIN, a gate terminal coupled to the PMOS transistor MP6, and a drain terminal coupled to the gate terminals of the pass transistor PT and the PMOS transistor MP3.

The constant current source CS3 and the PMOS transistors MN3~MN5 form a current source. In this embodiment, a current I5A flowing through the NMOS transistor MN3, is identical to a current I5B flowing through the NMOS transistor MN4 and the PMOS transistor MP4, and a current I5C flowing through the NMOS MN5 and the PMOS transistor MP5. Because a current I4 provided by the constant current source CS3 is equal to a sum of the current I5A (or I5B or I5C) and a current I6, the current I5A decreases as the current I6 increases.

Since the gate terminals of the pass transistor PT and the PMOS transistor MP3 are connected together and the drain terminals are connected to the node NOUT, a current I7 flowing through the PMOS transistor MP3 increases as the output current IOUT increases. Because the currents I5B and I5C flowing through the PMOS transistor MP4 and MP5 are limited by the NMOS transistors MN4 and MN5, a current I6 flowing through the resistor R3 increases such that a voltage level at the node ND3 accordingly decreases when the current I7 increases.

Once the output current IOUT exceeds a predetermined current, the voltage level at the node ND4 is decreased such that a voltage level at the node ND5 is increased to turn on the NMOS transistor NM6. As the NMOS transistor MN6 is turned on, a voltage level at the node ND7 is pulled low, such that the PMOS transistors MP6 and MP7 are turned on. As a result, the voltage level at the gate terminals of the pass transistor PT and the PMOS transistor MP3 is increased to decrease the output current IOUT, such that the output current IOUT can be limited to below the predetermined current. In this embodiment, the voltage level at the node ND5 can be regarded as being more sensitive to that at the node ND3, as the current I5A decreases. Namely, the current I5A (which is identical to the currents I5B and I5C) is in direct ratio to the predetermined current. Thus, in this embodiment, the COLC 20B can limit the output current IOUT to below a smaller predetermined current by decreasing the current I5A.

The NMOS transistor MN7 comprises a drain terminal coupled to the node ND6, a gate coupled to the NMOS transistor MN8, and a source terminal coupled to the ground voltage. The constant current source CS4 is coupled between the unregulated power supply voltage VIN and a node ND8. The PMOS transistor MN8 comprises a source terminal coupled to the node ND8, a gate terminal coupled to a division voltage (i.e., A.VOUT) of the output voltage VOUT and a drain terminal coupled to the NMOS transistor MN8, in which the coefficient A is smaller than 1. The NMOS transistor MN8 comprises a drain terminal coupled to the PMOS transistor MP8, a source terminal coupled to the ground voltage, and a gate terminal coupled to the drain terminal thereof and the gate terminal of the NMOS transistor MN7. The PMOS transistor MP9 comprises a source terminal coupled to the node ND8, a gate terminal coupled to the reference voltage VREF2, and a drain terminal coupled to the NMOS transistor MN9. The NMOS transistor MN9 comprises a drain terminal coupled to the PMOS transistor MP9, a gate terminal coupled to the drain terminal thereof, and a source terminal coupled to the ground voltage.

When the output voltage VOUT is lower than a predetermined voltage because of a short circuit (or a heavy load condition), the FOLC 30B enables the COLC 20B to further decrease the output current IOUT. For example, when the division voltage A.VOUT is higher than the reference voltage VREF2, the FOLC 30B determines that the output voltage VOUT is not lower than a predetermined voltage and does not increase the current IX flowing through the NMOS transistor MN7. Namely, the FOLC 30B does not drain out the current IX from the current I4 to decrease the current I5A/I5B/I5C to further decrease the predetermined current.

On the contrary, once the division voltage A.VOUT is lower than the reference voltage VREF2, the FOLC 30B determines that the output voltage VOUT is lower than the predetermined voltage, and thus, the current IX flowing through the NMOS transistor MN7 is accordingly increased as the output voltage VOUT decreases. The current I5A decreases as the current IX is increased because the current I4 is equal to the sum of the currents I5A and IX. Namely, when the output voltage VOUT is lower than the predetermined voltage, the FOLC 30B decreases the current I5A, such that the predetermined current for limiting the output current OUT is decreased as the output voltage decreases. In this example, the COLC 20B further decreases the output current IOUT according to the decreased predetermined current, i.e., the COLC 20B limits the output current IOUT to below the decreased predetermined current. As a result, the output current IOUT decreases as the output voltage VOUT decreases, when a short circuit (or a heavy load condition) occurs. Thus, damage caused by a short circuit or a heavy load condition can be prevented.

Figure 5:
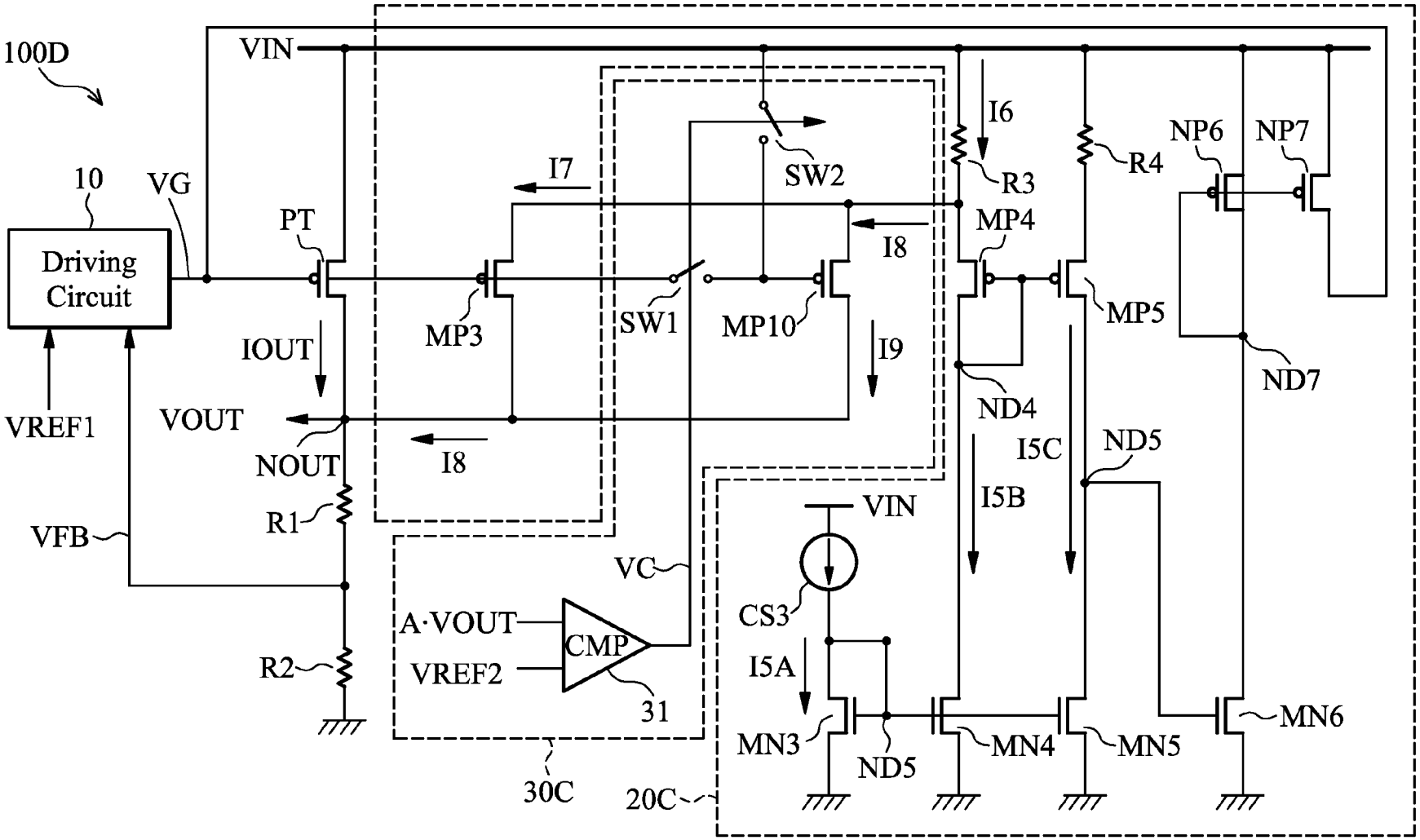
FIG. 5 shows another embodiment of the LDO regulator.

FIG. 5 shows another embodiment of the LDO regulator. As shown, the LDO regulator 100D is similar to the LDO regulator 100C in FIG. 4, differing only, in that the FOLC 30C increases a ratio of the current I8 to the output current IOUT to further decrease the predetermined current when the output voltage VOUT is smaller than the predetermined voltage, rather than changing the current I5A. Operations of the COLC 20C are similar to that illustrated in FIG. 4 and thus, are omitted for simplification.

The FOLC 30C comprises a comparator 31, two switching elements SW1~SW2, and a PMOS transistor MP10. The PMOS transistor MP10 comprises a source terminal coupled to the node ND3, a drain terminal coupled to the node NOUT, and a gate coupled to the switching elements SW1 and SW2, in which the size of the PMOS transistor MP10 is N times that of the PMOS transistor MP3. The switching element SW1 comprises a first terminal coupled to the gate terminal of the PMOS transistor MP10 and a second terminal coupled to the gate terminals of the pass transistor PT and the PMOS transistor MP3, and the switching element SW2 is coupled between the unregulated power supply voltage VIN and the gate terminal of the PMOS transistor MP10. The comparator 31 comprises a first input terminal coupled to the reference voltage VREF2, a second input terminal coupled to the division voltage A.VOUT of the output voltage VOUT and an output terminal coupled to the switching elements SW1 and SW2.

For example, when the division voltage A.VOUT is higher than the reference voltage VREF2, the FOLC 30C determines that the output voltage VOUT is not lower than a predetermined voltage. As a result, the comparator 31 outputs a control signal VC to turn the switching element SW1 and SW2 off and on respectively, such that the PMOS transistor MP10 is turned off. The FOLC 30C detects whether the output current IOUT exceeds the predetermined current by the PMOS transistor MP3 as illustrated in FIG. 4 to limit the output current IOUT to below the predetermined current. At this time, a current I8 is equal to the current I7 flowing through the PMOS transistor MP3.

On the contrary, when the division voltage A.VOUT is lower that the reference voltage VREF2 because of a short circuit (or a heavy load condition), the FOLC 30C determines that the output voltage VOUT is lower than the predetermined voltage. As a result, the comparator 31 outputs the control signals VC to turn the switching element SW1 and SW2 on and off respectively, mad the PMOS transistor MP10 is turned on to increase the current I8. In this embodiment, the currents I7 and I9 are both in direct ratio to the output current IOUT. The current I8 can be equal to a sum of the current I7 flowing through the PMOS transistor MP3 and a current I9 flowing through the PMOS transistor MP10. The ratio of the current I8 to the output current IOUT is increased to (I7+I9):IOUT from I7:IOUT.

As such, the current I6 flowing through resistor R3 is greatly increased, the voltage level of the node ND3 is accordingly decreased, and the voltage level at the node ND5 is increased. As a result, the NMOS transistor MN6 is turned on to pull the node ND7 lower, such that the PMOS transistors MP6 and MP7 are turned on. Hence, the voltage level at the gate terminals of the pass transistor PT and the PMOS transistor MP3 is increased to further decrease the output current IOUT. Hence, the COLC 20C can limit the output current IOUT to below the decreased predetermined current.

Because the LDO regulators 100 and 100A~100D of the embodiments can further decrease the output current as the output voltage decreases when a short circuit or a heavy load occurs, damage caused by short circuit or a heavy load condition can be prevented.

Certain terms are used throughout the description and claims to refer to particular system components. As one skilled in the art will appreciate, consumer electronic equipment manufacturers may refer to a component by different names. This document does not intend to distinguish between components that differ in name but not function.

Although the invention has been described in terms of preferred embodiment, it is not limited thereto. Those skilled in the art can make various alterations and modifications without departing from the scope and spirit of the invention. Therefore, the scope of the invention shall be defined and protected by the following claims and their equivalents.

What is claimed is:

1. A low dropout regulator, comprising:

a pass transistor receiving an unregulated power supply voltage to generate a regulated output voltage according to a control signal;

a constant overcurrent limiting circuit limiting an output current through the pass transistor to below a predetermined current; and a foldback overcurrent limiting circuit enabling the constant overcurrent limiting circuit to further decrease the output current, when the regulated output voltage is lower than a predetermined voltage, wherein the constant overcurrent limiting circuit determines whether the output current exceeds the predetermined current according to a first current which is in direct ratio to the output current, and when the regulated output voltage is lower than the predetermined voltage, the foldback overcurrent limiting circuit increase a ratio of the first current to the output current to decrease the predetermined current.

2. The low dropout regulator as claimed in claim 1, further comprising:

a feedback circuit detecting the regulated output voltage to generate a feedback signal; and a driving circuit generating the control signal according to a difference between the feedback signal and a reference signal.

3. The low dropout regulator as claimed in claim 1, wherein the constant overcurrent limiting circuit determines whether the output current exceeds the predetermined current according to a first current which is in direct ratio to the output current, and when the regulated output voltage is lower than the predetermined voltage, the foldback overcurrent limiting circuit increase a ratio of the first current to the output current to decrease the predetermined current.

4. A low dropout regulator, comprising:

a pass transistor receiving an unregulated power supply voltage to generate a regulated output voltage according to a control signal;

a constant overcurrent limiting circuit limiting an output current through the pass transistor to below a predetermined current; and a foldback overcurrent limiting circuit enabling the constant overcurrent limiting circuit to further decrease the output current, when the regulated output voltage is lower than a predetermined voltage, wherein the foldback overcurrent limiting circuit adjusts the predetermined current as the output voltage decreases when the regulated output voltage is lower than the predetermined voltage, such that the constant overcurrent limiting circuit further decreases the output current according to the adjusted predetermined current.

5. The low dropout regulator as claimed in claim 4, wherein the constant overcurrent limiting circuit increases a voltage level of the control signal according to the decreased predetermined current, thereby further decreasing the output current.

6. The low dropout regulator as claimed in claim 4, wherein the constant overcurrent limiting circuit comprises a current mirror providing at least one mirror current which is in direct ratio to the predetermined current, and when the regulated output voltage is lower than the predetermined voltage, the foldback overcurrent limiting circuit decreases the mirror current as the output voltage decreases, such that the predetermined current is accordingly decreased.

7. The low dropout regulator as claimed in claim 4, wherein the constant overcurrent limiting circuit comprises a current source providing a first current which is in direct ratio to the predetermined current, the foldback overcurrent limiting circuit drains out a second current from the first current or enables the current source to decrease the first current as the regulated output voltage decreases, such that the predetermined current is decreased, when the regulated output voltage is lower than the predetermined voltage.

8. An overcurrent protection circuit, comprising:

a constant overcurrent limiting circuit limiting an output current through a pass transistor below a predetermined current; and a foldback overcurrent limiting circuit enabling the constant overcurrent limiting circuit to further decrease the output current, when the regulated output voltage is lower than a predetermined voltage, wherein the foldback overcurrent limiting circuit decreases the predetermined current when the regulated output voltage is lower than the predetermined voltage, such that the constant overcurrent limiting circuit further decreases the output current according to the decreased predetermined current.

9. The overcurrent protection circuit as claimed in claim 8, wherein the constant overcurrent limiting circuit determines whether the output current exceeds the predetermined current according to a first current which is in direct ratio to the output current, and when the regulated output voltage is lower than the predetermined voltage, the foldback overcurrent limiting circuit increase a ratio of the first current to the output current to decrease the predetermined current.

10. An overcurrent protection circuit, comprising:

a constant overcurrent limiting circuit limiting an output current through a pass transistor below a predetermined current; and a foldback overcurrent limiting circuit enabling the constant overcurrent limiting circuit to further decrease the output current, when the regulated output voltage is lower than a predetermined voltage, wherein the foldback overcurrent limiting circuit adjusts the predetermined current as the output voltage decreases when the regulated output voltage is lower than the predetermined voltage, such that the constant overcurrent limiting circuit further decreases the output current according to the adjusted predetermined current.

11. The overcurrent protection circuit as claimed in claim 10, wherein, the constant overcurrent limiting circuit increases a voltage level of the control signal according to the decreased predetermined current, thereby further decreasing the output current.

12. The overcurrent protection circuit as claimed in claim 10, wherein the constant overcurrent limiting circuit comprises a current mirror providing at least one mirror current which is in direct ratio to the predetermined current, and when the regulated output voltage is lower than the predetermined voltage, the foldback overcurrent limiting circuit decreases the mirror current as the regulated output voltage decreases, such that the predetermined current is accordingly decreased.

13. The overcurrent protection circuit as claimed in claim 10, wherein the constant overcurrent limiting circuit comprises a current source providing a first current which is in direct ratio to the predetermined current; and the foldback overcurrent limiting circuit drains out a second current from the first current or enables the current source to decrease the input current as the output voltage decreases, such that the predetermined current is decreased, when the regulated output voltage is lower than the predetermined voltage.

14. A method for providing an overcurrent protection in a regulator, comprising:

limiting an output current through a pass transistor in the power regulator to below a predetermined current by a constant overcurrent limiting circuit;

decreasing the predetermined current to enable the constant overcurrent limiting circuit to further decrease the output current according to the decreased predetermined current, when a regulated output voltage of the pass transistor is lower than a predetermined voltage; and determining whether the output current exceeds the predetermined current according to a first current which is in direct ratio to the output current, wherein the predetermined current is decreased by increasing a ratio of the first current and the output current when the regulated output voltage is lower than the predetermined voltage.

15. A method for providing an overcurrent protection in a regulator, comprising:

limiting an output current through a pass transistor in the power regulator to below a predetermined current by a constant overcurrent limiting circuit; and decreasing the predetermined current to enable the constant overcurrent limiting circuit to further decrease the output current according to the decreased predetermined current, when a regulated output voltage of the pass transistor is lower than a predetermined voltage, wherein the predetermined current is decreased as the regulated output voltage decreases when the regulated output voltage is lower than the predetermined voltage, and the output current is further decreased by increasing a voltage level of the control signal according to the decreased predetermined current.

16. A method for providing an overcurrent protection in a regulator, comprising:

limiting an output current through a pass transistor in the power regulator to below a predetermined current by a constant overcurrent limiting circuit; and decreasing the predetermined current to enable the constant overcurrent limiting circuit to further decrease the output current according to the decreased predetermined current, when a regulated output voltage of the pass transistor is lower than a predetermined voltage, wherein the predetermined current is decreased by decreasing a mirror current of a current mirror in the constant overcurrent limiting circuit as the regulated output voltage decreases.

17. A method for providing an overcurrent protection in a regulator, comprising:

limiting an output current through a pass transistor in the power regulator to below a predetermined current by a constant overcurrent limiting circuit; and decreasing the predetermined current to enable the constant overcurrent limiting circuit to further decrease the output current according to the decreased predetermined current, when a regulated output voltage of the pass transistor is lower than a predetermined voltage, wherein the predetermined current is decreased by draining out a portion of a first current provided by a current source in the constant overcurrent limiting circuit as the regulated output voltage decreases, or enabling the current source to decrease the first current as the regulated output voltage decreases.

* * * * *